US005233729A

United States Patent [19]

Marmonier

[11] Patent Number: 5,233,729

[45] Date of Patent: Aug. 10, 1993

[54] DEVICE FOR CLOSING THE SHAFT OF A SKI BOOT

[75] Inventor: Gilles Marmonier, Saint Etienne de Crossey, Italy

[73] Assignee: Lange International S.A., Fribourg, Switzerland

[21] Appl. No.: 984,345

[22] Filed: Dec. 2, 1992

[30] Foreign Application Priority Data

Jan. 29, 1992 [CH] Switzerland ..... 253/92

[51] Int. Cl.[5] ..... A43C 11/00

[52] U.S. Cl. ..... 24/68 SK; 24/70 SK; 36/50.5

[58] Field of Search ..... 24/68 SK, 70 SK, 69 SK, 24/71 SK, 68 CD; 36/50.5

[56] References Cited

U.S. PATENT DOCUMENTS 3,258,820 7/1966 Steinberg ..... 24/70 SK
4,553,292 11/1985 Pradier et al. ..... 24/68 SK
4,683,620 8/1987 Valsecchi et al. ..... 24/68 SK
4,761,898 8/1988 Courvoisier et al. ..... 36/50.5
4,856,210 8/1989 Delery ..... 24/68 SK

FOREIGN PATENT DOCUMENTS 0242531 2/1987 European Pat. Off. .
2485344 6/1981 France .

*Primary Examiner*—Victor N. Sakran
*Attorney, Agent, or Firm*—Kane, Dalsimer, Sullivan, Kurucz, Levy, Eisele and Richard

[57] ABSTRACT

The device comprises a tensioning lever which acts on a traction member connected to the tensioning lever by means of a slide. At the time of opening of the tensioning lever, the traction member is held at the end of the slide close to the axis by an automatic retention member, such as a catch articulated on the tensioning lever. Pressure on the tensioning lever has the effect of acting on the catch which then frees the traction member which slides to the other end of the slide. Three positions can thus be obtained: closed, relaxation, open. A second traction member can be connected to the same tensioning lever.

4 Claims, 3 Drawing Sheets

DEVICE FOR CLOSING THE SHAFT OF A SKI BOOT

FIELD OF THE INVENTION

The present invention relates to a device for closing the shaft of a ski boot, comprising a tightening lever articulated on a support intended to be fixed on a part of the shaft of the boot, this tensioning lever being connected, at a point situated between its articulation and its end, to a traction member intended to be connected to another part of the shaft, the device comprising means allowing it to occupy an intermediate position between its closed position and its open position when the tensioning lever is brought from its closed position towards its open position.

PRIOR ART

Such a closing device is known from the U.S. Pat. application No. 4,761,898. This device is intended to close a shaft in the form of a collar. It consists of a toothed belt which is fixed to one of the parts of the shaft and slides in a stirrup equipped with a catch which is engaged in the toothing of the belt, on which stirrup there is articulated a tensioning lever which is moreover articulated at a second point to another part of the shaft of the boot. The tensioning lever has an extension in the form of a nose beyond its articulation, this nose coming to raise the catch and free the toothed belt at the time of opening of the tensioning lever, after a large angle of rotation of the tensioning lever. The tensioning lever therefore occupies, at a given moment, an intermediate position, in which the boot is loosened but not open. This position is only, however, a transient position, in which the tensioning lever is not immobilized and it was not envisaged to use this closing device to obtain a stable intermediate position between the clamping position and the open position, that is to say a position of relaxation of the clamping. Taking account of the ratio of the lever arms, obtaining a stable intermediate position would necessitate having a very powerful catch spring, which would require a great force to make the toothed belt slide at the time of closing of the boot. Moreover, this previous device does not make it possible to retain adjustment of the clamping force.

SUMMARY OF THE INVENTION

The aim of the invention is to produce a closing device which is capable of occupying a stable intermediate position making it possible to obtain a position of relaxation of the clamping, that is to say a rest or walking position. Passing into open position is to take place by relatively great pressure on the tensioning lever. Moreover, complete opening of the device is to take place without loss of the adjustment.

The closing device according to the invention is characterised in that said traction member is connected to the tensioning lever by means of a slide provided on the tensioning lever or on the traction member, in which slide the traction member, respectively the tensioning lever, is articulated, the tensioning lever comprising a member for automatic retention of the part engaged in the slide at one end of this slide corresponding to the intermediate position, this retention member projecting on the tensioning lever in such a manner that it comes opposite the boot when the tensioning lever is brought from its closed position to its open position and that it can then be actuated by pressure on the tensioning lever, freeing the part engaged in the slide and allowing it to slide to the other end of the slide.

The retention member can be constituted simply by a catch, the end of which has a frontal housing, in which the sliding part comes to engage and be attached when the tensioning lever is in the open position. This catch comes to abut against the boot and it is actuated by a pressure on the tensioning lever.

The tensioning lever can act on a second traction member connected to the tensioning lever at a point approximately opposite the first traction member relative to the axis of articulation of the tensioning lever on its support, which makes it possible to increase the amplitude of the relaxation without increasing the resistant lever arms opposing the opening of the device.

BRIEF DESCRIPTION OF THE DRAWINGS

The attached drawing represents, by way of example, an embodiment of the device according to the invention.

DESCRIPTION OF THE PREFERRED EMBODIMENT(S)

Figure 1:
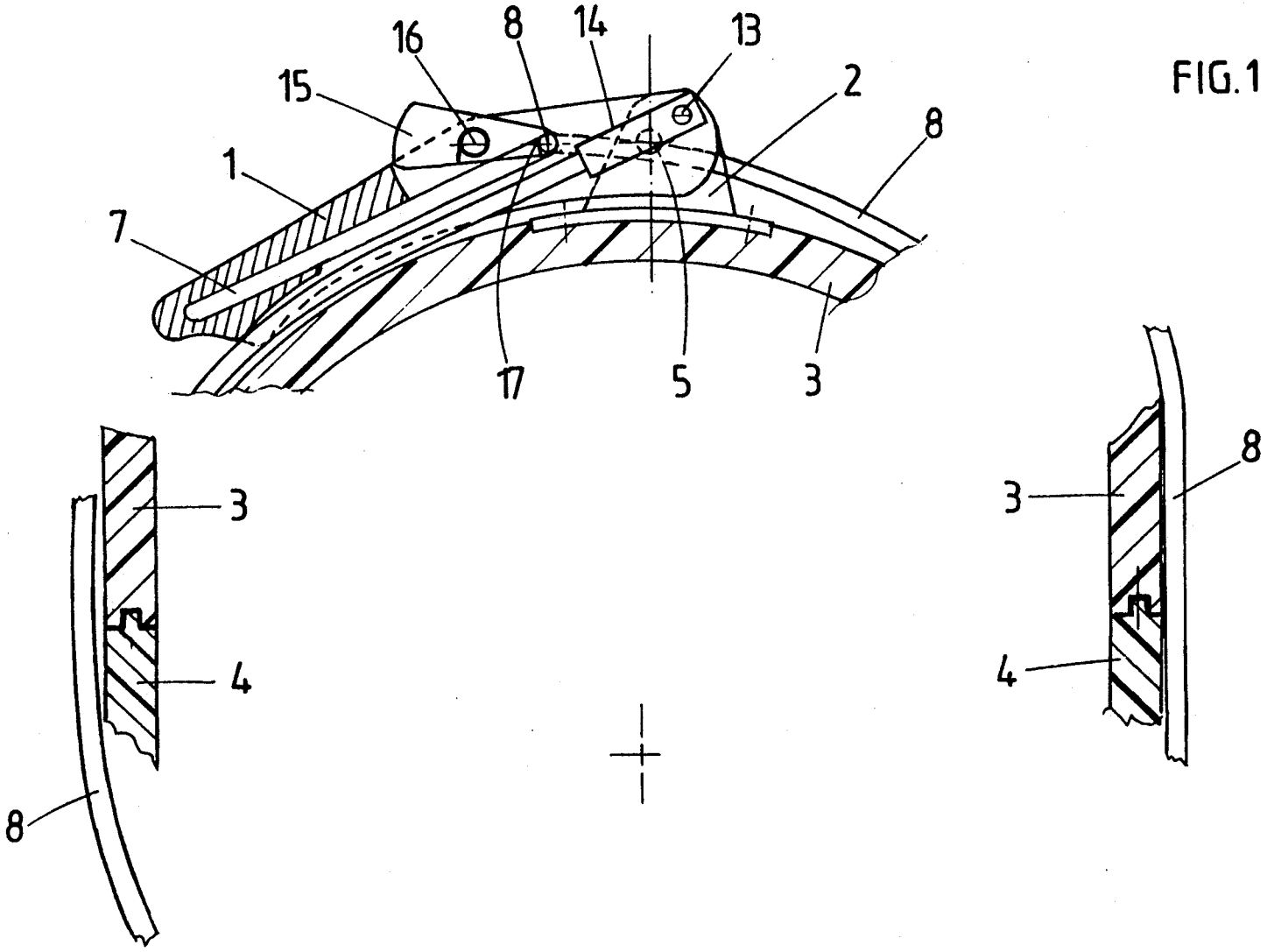
FIG. 1 is a view of the device in the closed position along a section I—I in FIG. 2.
Figure 2:
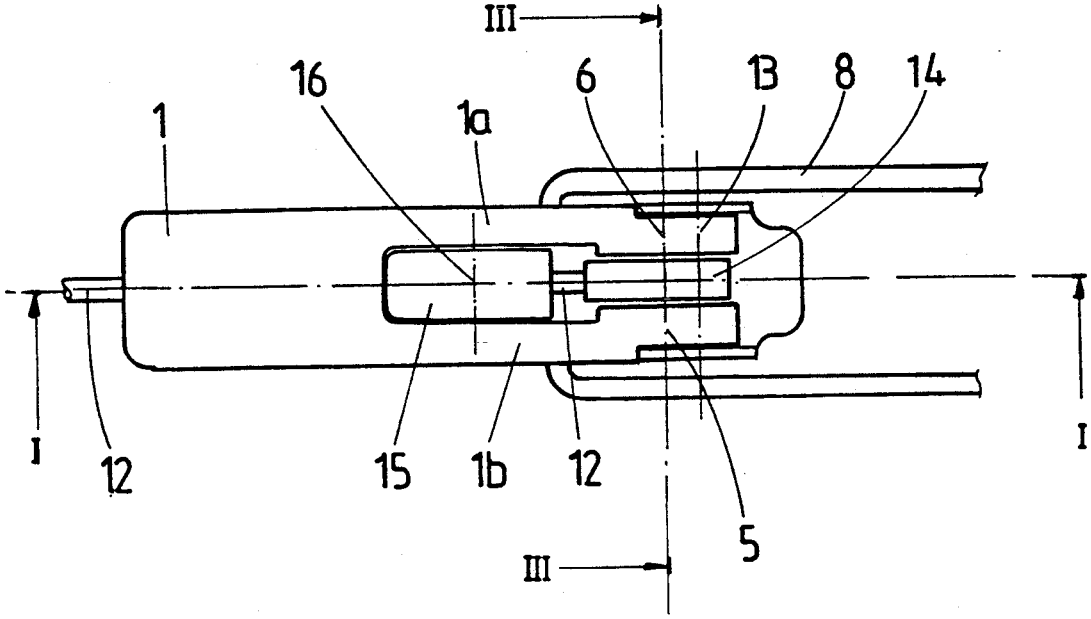
FIG. 2 is a partial view of the device in the closed position seen from the front.
Figure 3:
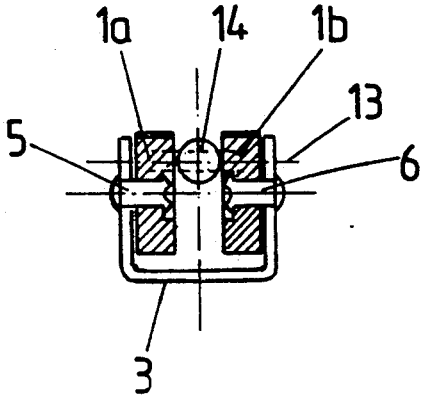
FIG. 3 is a view in section according to III—III in FIG. 2.

The device shown comprises essentially a tensioning lever 1 articulated in a stirrup 2 fixed on the front part 3 of a ski boot shaft constituted by the front part 3 and by a rear part 4 which comes to interlock via its edges in the edges of the front part 3 in the closed position, as described in French Patent Application No. 91 02521. The front part 3 has two flaps which make possible clamping of the shaft on the front of the leg.

The tensioning lever 1 is divided into two branches 1*a* and 1*b* articulated on the wings of the stirrup 2 by means of two rivets 5 and 6. The lever 1 has a slot 7 extending over the greater part of the length of the tensioning lever. Engaged in this slot is a rectangular buckle 8 which goes around the rear part 4 of the boot and the other end of which interacts with the toothing of a rack (not shown) fixed to the other side of the front part 3 of the shaft.

A second cable 12 is attached to the tensioning lever about an axis 13 situated on the other side of the articulation 5 of the tensioning lever relative to the slot 7. This cable surrounds the shaft via the front and has at its end a toothing (not shown) which comes to be attached on the other side of the front part 3. The aim of this cable is to make possible adaptation (by sliding on one another two flaps on the front) of the front part of the shaft to the morphology of the lower part of the leg of the user.

The attachment of the cable 12 to the tensioning lever is produced by means of an attachment piece 14 articulated between the arms 1*a* and 1*b* of the tensioning lever. On the tensioning lever, between the arms la and 1*b*, a catch 15 is moreover articulated about an axis 16, about which there is moreover mounted a spring in the shape of a hunting horn which tends to bring the catch 15 back into the position represented in FIG. 1. The internal end of the catch 16 has a concavity at 17. In the rest position of the catch 15, this concavity is opposite the buckle 8 abutting against the end of the slot 7 close to the articulation of the tensioning lever, so that the slot 7 is closed by one of the faces of the concavity in V form 17, a face which is slightly oblique relative to the axis of the slot 7.

In the closed and tightened position represented in FIG. 1, the buckle 8 is at the end of the slot 7 close to the articulation of the tensioning lever and the articulation of the cable 12 is positioned in such a manner that the direction of the traction exerted on the axis 13 passes above the articulation 5/6 of the tensioning lever (in the drawing) so that this traction acts in the direction of closing of the tensioning lever.

In the same manner, the direction of the force on the buckle 8 passes below the axis 5/6, leading likewise to the buckle being kept in the closed position.

It is to be noted that, given the proximity of the axis 13 and of the buckle 8, the torque is relatively weak and therefore easy to overcome at the time of opening of the tensioning lever.

It will be noted that, in the closed clamped position, the attachment points of the buckle 8 and of the cable 12 to the tensioning lever are relatively close to the articulation of the tensioning lever. Consequently, when the tensioning lever is opened, a relatively reduced relaxation is allowed on the one hand on the buckle 8 and on the other hand on the cable 12 which permits reduced opening, by pivoting the rear cap towards the rear.

Figure 4:
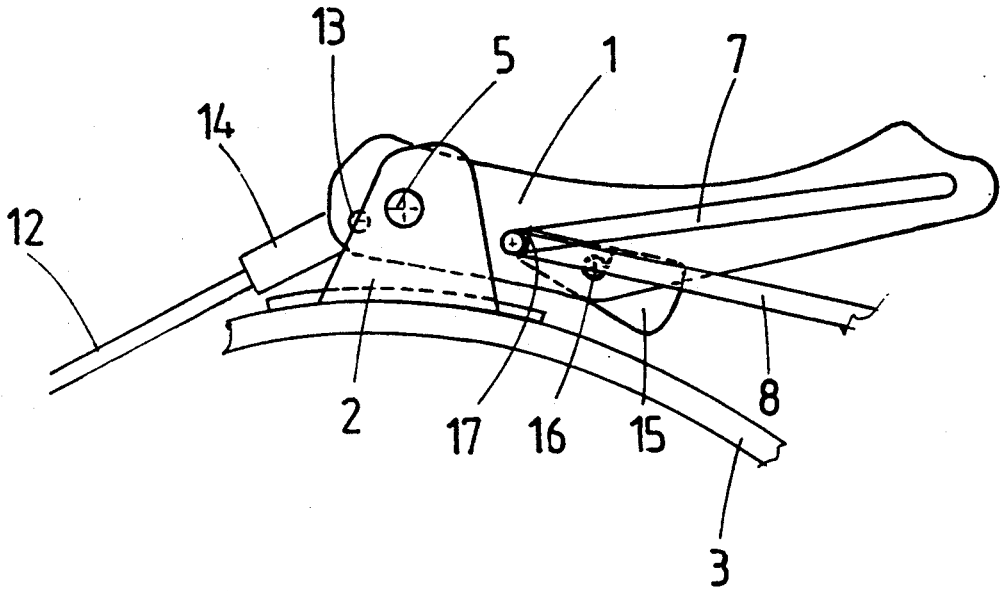
FIG. 4 is a partial view of the device in the intermediate position, of relaxation.

The addition of these two relaxations gives rise to a good relaxation of the clamping of the leg, a relaxation which allows the rest and walking position (FIG. 4).

In this position, the buckle 8 comes to abut against the concavity 17 of the catch 15, more specifically against the oblique side of this concavity, and it is thus locked by the catch 15.

Figure 5:
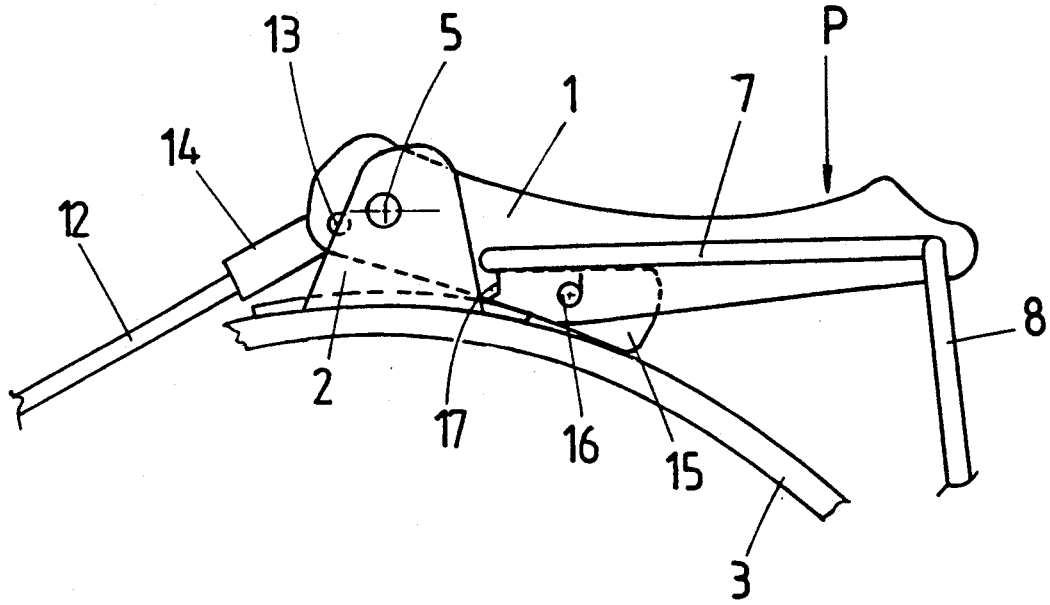
FIG. 5 is a partial view of the device in the open position.

Starting from the position represented in FIG. 4, if the user exerts a pressure P on the tensioning lever, the catch 15, which projects on the tensioning lever (under this lever in the position represented in FIGS. 4 and 5), is actuated against the action of its spring and frees the buckle 8 which can thus slide as far as the other end of the slot 7, thus lengthening the collar formed by the closing device around the shaft of the boot, allowing the opening of this shaft in the region of the joining plane of these two parts.

The extent of the relaxation is determined by the distance of the attachment points of the buckle 8 and of the cable 12 to the articulation of the tensioning lever, while the amplitude of the opening of the boot is determined by the length of the slot 7, that is to say the length of the tensioning lever.

A closing device with three positions is thus obtained: a closed clamped position, a position of relaxation and an open position of the boot.

At the time of putting the boot on, the lever 1 is brought back into the position represented in FIG. 1 and the buckle 8 slides to the other end of the slot 7, raising the catch 15 which locks the buckle 8 again at this end of the slot.

In a simplified embodiment of the invention, particularly adapted to boots known as rear-entry boots, the second traction element constituted by the cable 12 could be eliminated. In another embodiment, instead of being constituted by a buckle such as the buckle 8, the first working traction element could be constituted by a pull equipped with a small transverse bar at its end, which bar can slide in two opposite grooves formed in the tensioning lever.

A reversal is possible in principle, it being possible for the slot and the catch to be on a piece which is integral with the traction member. Since the piece bearing the catch undergoes no reversal in this case, stop means must be provided in the closed position or prevent untimely actuation of the catch.

The closing device according to the invention can be applied to any type of boot, such as boots with a shaft in the form of a collar in one piece or conventional rear-entry type boots.

I claim:

1. A device for closing the shaft of a ski boot, comprising a tensioning lever (1) articulated on a support intended to be fixed on a part of the shaft of the boot, this tensioning lever being connected, at a point situated between its articulation and its end, to a traction member (8) intended to be connected to another part of the shaft of the boot, the device comprising means allowing it to occupy an intermediate position between its closed position and its open position when the tensioning lever is brought from its closed position towards its open position, wherein said traction member (8) is connected to the tensioning lever (1) by means of a slide (7) arranged on the tensioning lever or on the traction member, in which slide the traction member (8), respectively the tensioning lever, is articulated, the part having the slide (7) comprising a member for automatic retention (15) of the part (8) engaged in the slide at one end of this slide corresponding to the intermediate position, this retention member (15) projecting on the piece which bears it in such a manner that it comes opposite the boot when the tensioning lever is brought from its closed position to its open position and that it can then be actuated by pressure on the tensioning lever, freeing the part engaged in the slide and allowing it to slide to the other end of the slide.

2. The closing device as claimed in claim 1, wherein the slide is constituted by a longitudinal slot (7) provided on the tensioning lever and wherein the traction member comprises a rectangular buckle (8) passing through this slot.

3. The closing device as claimed in claim 2, wherein the retention member is constituted by a catch (15) which is articulated on the tensioning lever (1) and subjected to the action of a return spring, this catch having an arm projecting on the tensioning lever for its actuation.

4. The closing device as claimed in claim 1, which comprises a second traction member (12) connected to the tensioning lever at a point (13) approximately opposite the first traction member relative to the axis of articulation of the tensioning lever on its support.

* * * * *